US007131377B2

(12) United States Patent
Schaffrath

(10) Patent No.: US 7,131,377 B2
(45) Date of Patent: Nov. 7, 2006

(54) OSCILLATING MECHANISM FOR A DISTRIBUTOR ROLL OF A PRESS

(75) Inventor: Dieter Schaffrath, Lorsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 65 days.

(21) Appl. No.: 11/012,779

(22) Filed: Dec. 15, 2004

(65) Prior Publication Data

US 2005/0126409 A1 Jun. 16, 2005

(30) Foreign Application Priority Data

Dec. 15, 2003 (DE) ..... 103 58 543

(51) Int. Cl.
*B41F 31/15* (2006.01)

(52) U.S. Cl. ..... 101/352.06; 101/350.3; 101/DIG. 38

(58) Field of Classification Search ..... 101/352.06, 101/DIG. 38, 350.3, 348, 349.1; 492/15; 74/25, 89

See application file for complete search history.

(56) References Cited

U.S. PATENT DOCUMENTS

| | | | | |
|---|---|---|---|---|
| 2,697,983 | A * | 12/1954 | Taylor | 101/348 |
| 3,118,373 | A * | 1/1964 | Mosemiller | 101/348 |
| 4,620,481 | A * | 11/1986 | Steiner | 101/350.3 |
| 5,619,922 | A | 4/1997 | Kelm | |
| 6,220,159 | B1 | 4/2001 | Wieland | |
| 6,498,445 | B1 * | 12/2002 | Fujiwara et al. | 318/119 |
| 6,578,481 | B1 | 6/2003 | Beisel et al. | |
| 6,772,685 | B1 | 8/2004 | Schaffrath | |
| 2003/0079632 | A1 * | 5/2003 | Schaffrath | 101/350.3 |

FOREIGN PATENT DOCUMENTS

| | | |
|---|---|---|
| DE | 185 198 | 5/1907 |
| DE | 44 42 302 A1 | 5/1996 |
| DE | 197 36 118 C2 | 3/1999 |
| DE | 197 56 077 A1 | 6/1999 |
| DE | 100 61 652 A1 | 7/2001 |
| DE | 102 27 516 A1 | 5/2003 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

An oscillating mechanism for a distributor roll of a press has a spatial crank mechanism.

12 Claims, 7 Drawing Sheets

OSCILLATING MECHANISM FOR A DISTRIBUTOR ROLL OF A PRESS

BACKGROUND OF THE INVENTION

Field of the Invention

The present invention relates to an oscillating mechanism for a distributor roll of a press. The oscillating mechanism includes a crank mechanism.

German published patent application DE 185 198 describes such an oscillating mechanism. The crank mechanism of that oscillating mechanism is a plane crank mechanism (i.e., plane linkage), and therefore takes up a comparatively large amount of space within the distributor roll. This opposes any reduction in the roll diameter, which is worth striving for in some applications.

SUMMARY OF THE INVENTION

It is accordingly an object of the invention to provide an oscillating mechanism for a distributor roll of a press which overcomes the above-mentioned disadvantages of the heretofore-known devices and methods of this general type and which provides for an oscillating mechanism that is beneficial towards a reduction in the roll diameter.

With the foregoing and other objects in view there is provided, in accordance with the invention, an oscillating mechanism for a distributor roll of a press, comprising a crank mechanism for oscillating the distributor roll in the form of a spatial (i.e., three-dimensional) crank mechanism.

The crank mechanism of the oscillating mechanism according to the invention is therefore not a crank mechanism having flat kinematics but a crank mechanism having spatial or three-dimensional kinematics. By definition, in the case of this spatial crank mechanism, a mechanism element attached to a crank of this crank mechanism is moved in at least one other movement plane than the crank. If the mechanism element is a swing arm, the latter has at least one oscillation plane which is different from the circulation plane of the crank. Such a spatial crank mechanism requires so little space within the distributor roll that not only is it possible for the diameter of the latter to be kept small but, moreover, a further mechanism can also be integrated in the latter and, for example, can be used to reduce a high rotational frequency of the distributor roll to a low reciprocating frequency of the distributor roll, which is advantageous in particular for high-speed presses. A further additional advantage is to be seen in the fact that the spatial crank mechanism, as opposed to a plane crank mechanism, permits a large reciprocating range, that is to say a large amplitude of the axial linear oscillation of the distributor roll, which is likewise beneficial to thorough distribution, in spite of a small roll diameter and, accordingly, restricted space for the movement of the mechanism elements integrated in the interior of the roll.

In accordance with an added feature of the invention, the crank mechanism has a crank and a swing arm attached to the crank and disposed to oscillate in different oscillation planes. These oscillation planes can be oriented orthogonally to one another.

In another development, the swing arm is mounted in a joint having a plurality of degrees of freedom. This joint can be assembled from a plurality of partial joints, which in each case only have a single degree of joint freedom. This is the case, for example, if the joint is a cardan joint or a universal joint.

According to a further development, the crank mechanism has a crankshaft which is not oriented at an angle to a roll axle of the distributor roll. The crankshaft can, for example, be oriented parallel to the roll axle. The crankshaft is preferably oriented coaxially with the roll axle.

Advantageous with regard to movement equalization is a development according to which the crank is connected to the crankshaft in an articulated manner. In this case, there is no rigid connection between the crank and its crankshaft, and the crank is fitted to the crankshaft such that it can be moved or pivoted relative to the latter.

A further development includes having the swing arm mounted such that it can oscillate about a first axis of rotation and about a second axis of rotation oriented crosswise relative to the first axis of rotation. The swing arm therefore has two different imaginary axes of rotation, which preferably not only cross but also intersect, that is to say extend in one and the same three-dimensional plane. These axes of rotation are the axes of rotation of the aforementioned cardan joint and determine its plurality of degrees of freedom.

In a development which is advantageous with regard to maximizing the reciprocating range of the distributor roll, the second axis of rotation is arranged to be offset by a radial distance relative to a mid-axis of the crank. An arrangement of the second axis of rotation which is eccentric with respect to the crank and its crankshaft is therefore provided.

A further development is characterized by the fact that the swing arm has a first lever arm, which is connected to the crank in an articulated manner, and a second lever arm, which is connected to a roll barrel of the distributor roll in an articulated manner. In the crank mechanism, use is therefore made of a double-arm swing arm as a connecting rod.

Advantageous with regard to omitting a positive rotary drive for the distributor roll is a development according to which the distributor roll is driven in rotation by roll friction. An adjacent roll driving the distributor roll via friction can be the only roll with which the distributor roll is in rolling contact.

Advantageous with regard to maintenance of the distributor roll carried out outside the press, for example cleaning, is a development according to which the crank mechanism is arranged inside the distributor roll. The integration of the crank mechanism in the roll barrel of the distributor roll is possible without difficulty on account of the formation of the crank mechanism as a spatial crank mechanism and the compactness of the crank mechanism which is thereby provided. The distributor roll and the crank mechanism can be removed together from the press and therefore do not need to be separated from each other.

The invention also includes a press which is equipped with the oscillating mechanism according to the invention or one constructed in accordance with the developments. This press can have a printing form cylinder to which a damping unit is assigned for its damping and an inking unit for its inking. The distributor roll having the oscillating mechanism can be a damping solution distributor of the damping unit or an ink distributor of the inking unit.

Other features which are considered as characteristic for the invention are set forth in the appended claims.

Although the invention is illustrated and described herein as embodied in an oscillating mechanism for a distributor roll of a press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
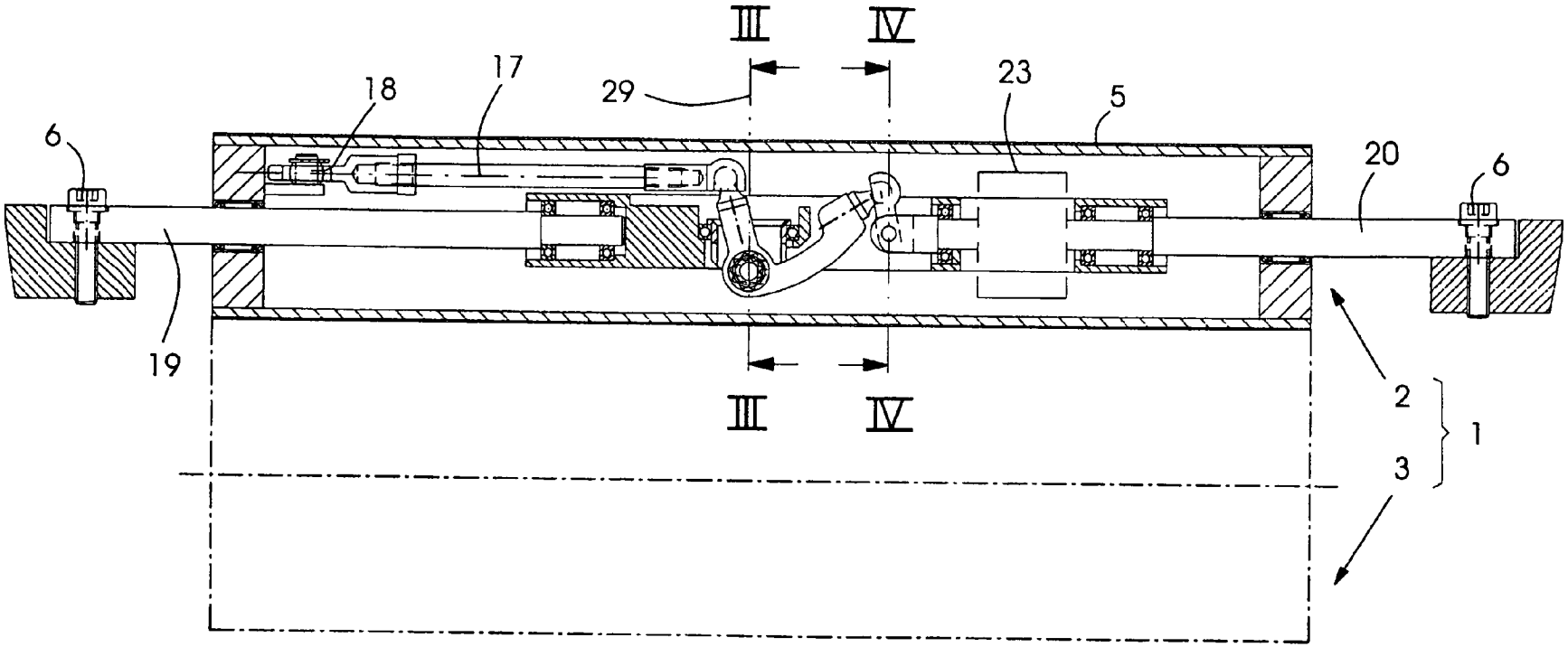
FIG. 1 is a longitudinal section, along a vertical section plane, of a distributor roll.
Figure 2:
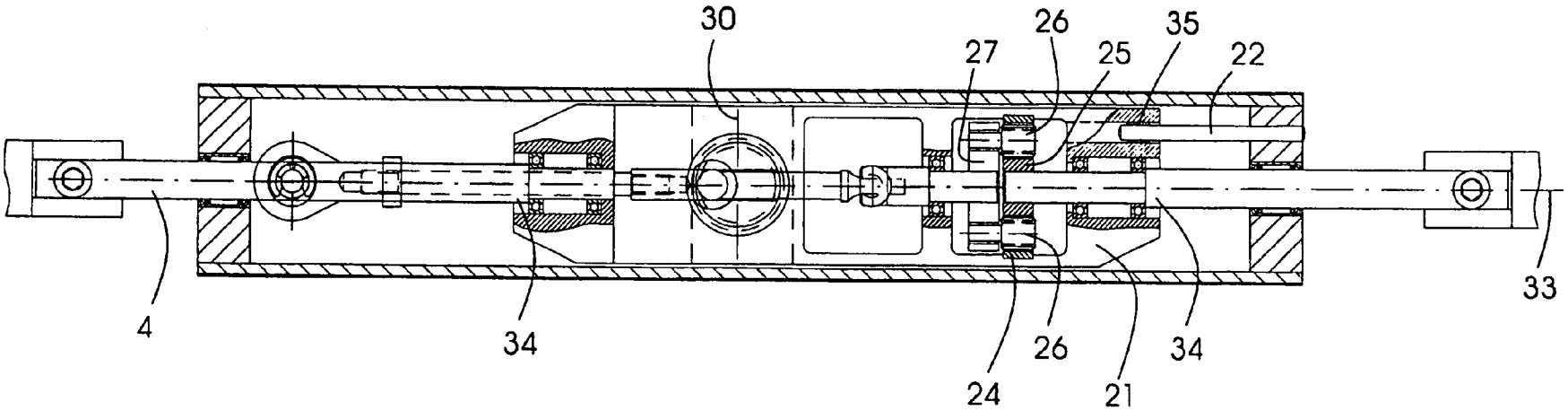
FIG. 2 is a longitudinal section, along a horizontal section plane, of the distributor roll.
Figure 4:
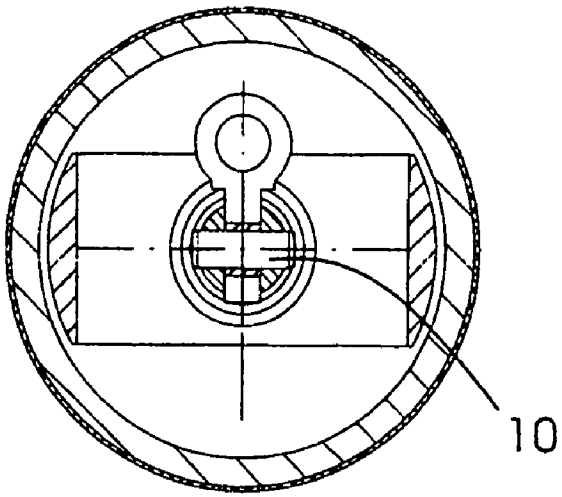
FIG. 4 is a cross-sectional view taken along the section line IV—IV in FIG. 1.
Figure 3:
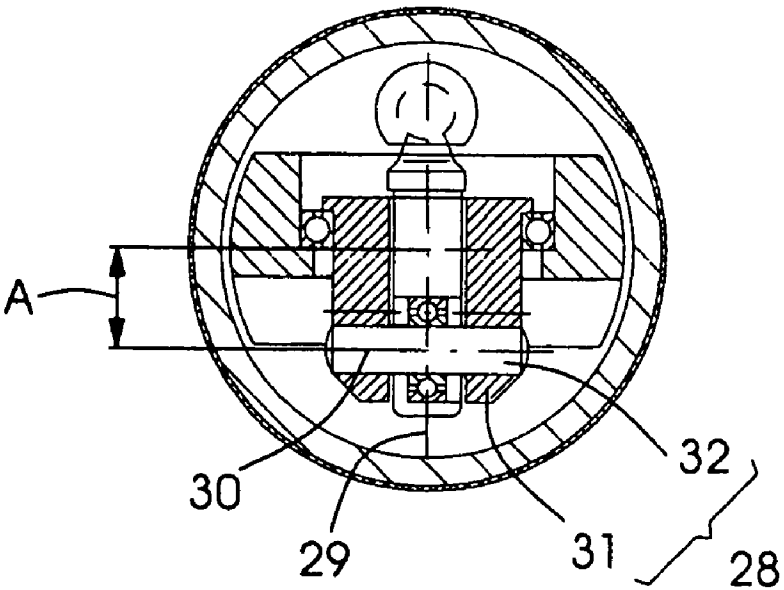
FIG. 3 is a cross-sectional view taken along the section line III—III in FIG. 1.
Figure 5:
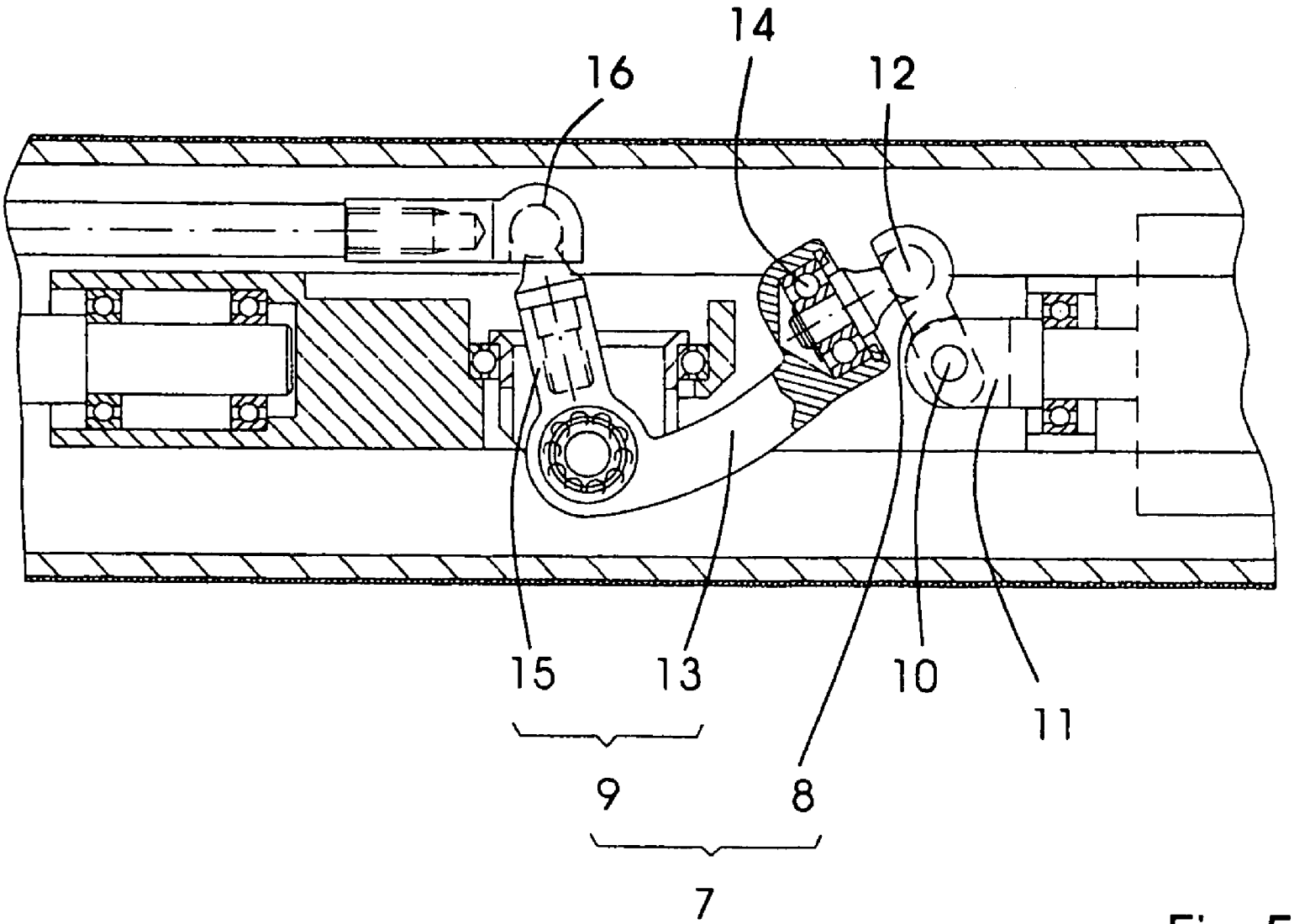
FIG. 5 is an enlarged detail illustration of a crank mechanism integrated into the distributor roll.
Figure 6:
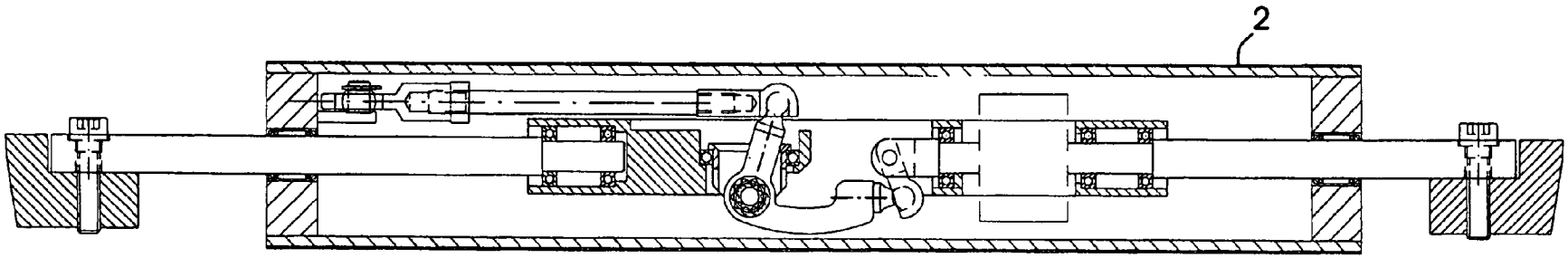
FIG. 6 shows the distributor roll in the longitudinal sectional illustration corresponding to FIG. 1, with the crank mechanism assuming a rotary angle position rotated onward through 180° as compared with FIG. 1.
Figure 7:
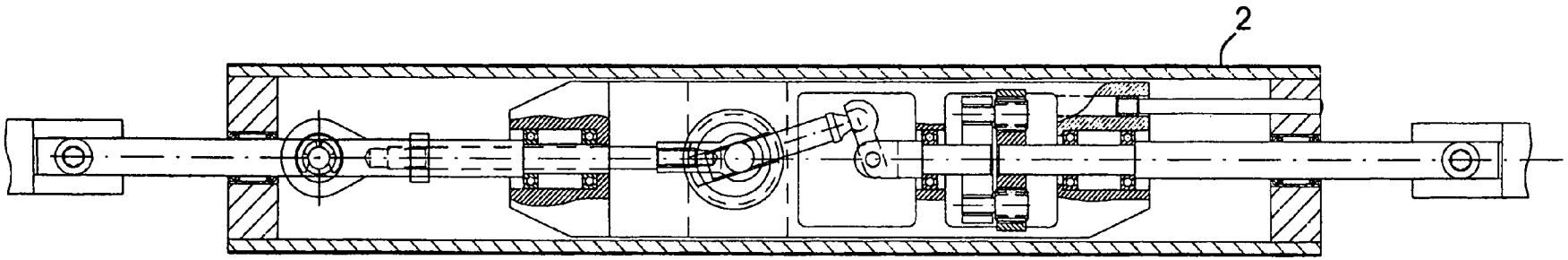
FIG. 7 is a longitudinal sectional view of the distributor roll corresponding to FIG. 2, with the crank mechanism assuming a rotary angle position rotated onward through 90° relative to FIG. 2.
Figure 8:
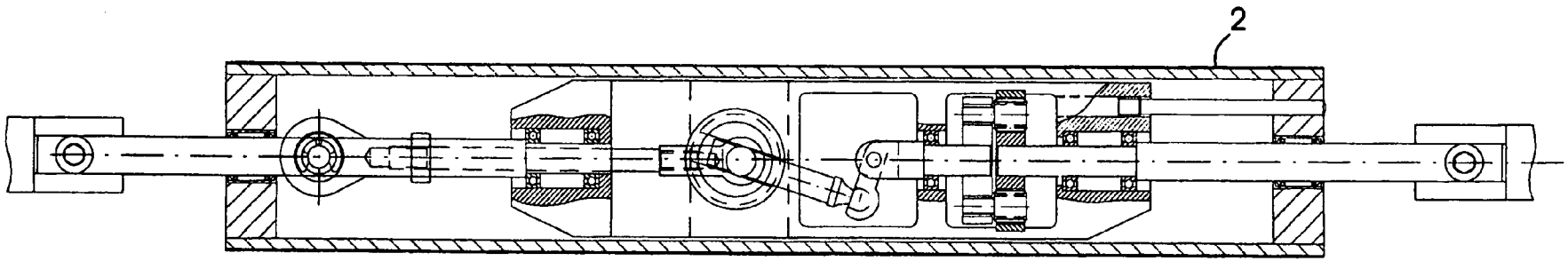
FIG. 8 is a similar longitudinal sectional view of the distributor roll, here with the crank mechanism assuming a rotary angle position rotated onward through 270° relative to FIG. 2.

Referring now to the figures of the drawing in detail, FIGS. 1 to 8 illustrate a detail from a printing machine or press 1 for offset lithographic printing. The press 1 comprises a distributor roll 2 and a further roll 3, which drives the distributor roll 2 in rotation by roll friction, so that no pair of gears connecting the distributor roll 2 to the further roll 3 is required. The further roll 3 is indicated by phantom lines in FIG. 1. The distributor roll 2 comprises a multi-part roll axle 4 and a hollow roll barrel 5, which is mounted on the roll axle 4 such that it can rotate about the latter and can be displaced along the latter. The roll axle 4 is secured so as to be fixed against rotation and in roll fasteners 6 formed as quick-action fasteners. The rapid release and fastening of the roll fasteners 6 is advantageous with regard to the temporary removal of the distributor roll 2 from the press 1 for maintenance purposes.

A crank mechanism 7 is arranged in the interior of the distributor roll 2. The crank mechanism 7 has three-dimensional mechanism kinematics, which transforms the rotation of the roll barrel 5 into its axial to-and-fro movement. The crank mechanism 7 comprises a crank 8 and a swing arm 9 attached to the latter as a connecting rod. The crank 8 is connected to a crankshaft 11 in a rotationally articulated manner via a first joint 10, and is connected to a first lever arm 13 of the swing arm 9 via a second joint 12. The first lever arm 13 is the force arm and is longer than the second lever arm 15, which is the load arm of the L-shaped swing arm 9. The first joint 10 has a single axis of rotation which is oriented at right angles with respect to the crankshaft 11. The crankshaft 11 is not oriented at an angle to the roll axle 4 and is aligned coaxially with the latter. The second joint 12 has a number of degrees of joint freedom and is a spherical joint. Accordingly, the second joint 12 has a geometric axis of rotation which is oriented at right angles relative to the crankshaft and even a plurality of axes of rotation oriented in this way, which determine the degrees of joint freedom. The spherical head of the second joint 12 is mounted in the swing arm 9 via an antifriction bearing 14 serving to reduce the wearing load on the second joint 12. A second lever arm 15 of the swing arm 9 is connected via a third joint 16 to a coupling rod 17, which is connected to the roll barrel 5 via a fourth joint 18. The third joint 16 has a plurality of degrees of joint freedom and is a spherical joint. The fourth joint 18 is a rotary joint and has an axis of rotation oriented at right angles relative to the roll axle 4 and to the crankshaft 11.

The roll axle 4 is assembled from a first axle pin 19 and a second axle pin 20 aligned with the latter. Arranged between the two axle pins 19, 20 is a plate-like frame-like gearbox housing (mechanism carrier) 21, which is rotatably mounted on the roll axle 4 or its axle pins 19, 20. The gearbox housing 21 is connected to the roll barrel 5 via a pin-like driver 22 so as to be fixed against rotation and, in addition to the crank mechanism 7, also carries a step-down gearbox 23, which is merely indicated schematically in FIGS. 1 and 5 and is illustrated in detail in FIG. 2.

The step-down gearbox 23 reduces the high rotational speed of the roll barrel 5 and therefore of the gearbox housing 21 to a lower rotational speed of the crank 8. The reduced rotational speed of the crank 8 has the effect of a correspondingly low oscillation frequency of the swing arm 9 and, as a result of this, a low frequency of the axial linear oscillation of the roll barrel 5, which is in turn advantageous for uniform distribution of the liquid on the distributor roll 2. This liquid can be a printing ink, a damping solution or an emulsion formed from the two. The step-down gearbox 23 is constructed as a planetary gearbox and comprises an internal gear 24, a sun wheel 25, planet wheels 26 and a revolving spider 27. The internal gear 24 is seated so as to be fixed against rotation in the gearbox housing 21, the sun wheel 25 is seated so as to be fixed against rotation on the second axle pin 20, and the spider 27 is seated so as to be fixed against rotation on the crankshaft 11. The crankshaft 11 and the spider 27 are rotatably mounted in the gearbox housing 21 via an antifriction bearing. The planet wheels 26 are rotatably mounted in the spider 27 and are in each case engaged by teeth both with the internal gear 24 and with the sun wheel 25.

The swing arm 9 is mounted in the gearbox housing 21 via a fifth joint 28, which has a plurality of degrees of joint freedom. The fifth joint 28 is a cardan or universal joint and has a first axis of rotation 29 and a second axis of rotation 30. The two axes of rotation 29, 30 cross at right angles and are in each case oriented at right angles relative to the roll axle 4 and the crankshaft 11. The first axis of rotation 29 is determined by a bush-like coupling ring 31, which is rotatably mounted in the gearbox housing 21 by means of an antifriction bearing. The second axis of rotation 30 is determined by a transverse pin 32 which functions as a joint pin, is seated in the coupling ring 31 and on which the swing arm 9 is rotatably mounted via an antifriction bearing.

The axis of rotation of the first joint 10 is oriented parallel to the first axis of rotation 29 in two diametrically opposite rotary angle positions (cf. FIGS. 7 and 8) of the crank 8, and parallel to the second axis of rotation 30 in two other diametrically opposite rotary angle positions (cf. FIGS. 1 and 2) of the crank 8. Because of its multiaxial mounting, explained previously, the swing arm 9 executes a periodic swinging movement about the first axis of rotation 29 and in a first oscillation plane (image plane of FIG. 2) and, at the same time, a further periodic swinging movement about the second axis of rotation 30 and in a second oscillation plane (image plane of FIG. 1). Each of the two oscillation planes extends at right angles relative to the circulation plane (image plane of FIG. 4) of the crank 8. The crank mechanism 7 therefore has three different movement planes, namely the circulation plane of the crank 8 and the two different oscillation planes of the swing arm 9. The crank mechanism 7 is therefore a spatial or three-dimensional crank mechanism. As a consequence of the superimposition of these two flat swinging movements, the result is a resultant three-dimensional oscillation of the swing arm 9.

Advantageous with regard to maximizing the axial roll stroke is the greatest possible eccentricity of the second axis of rotation 30, that is to say the greatest possible radial distance A between the second axis of rotation 30 and a geometric mid-axis 33, about which the distributor roll 2 and its crank 8 rotate.

The gearbox housing 21 is secured axially against displacements taking place relative to the roll axle 4 by means of axle attachments 34 on the roll axle 4. The driver 22 is firmly seated with one end in the roll barrel 5 or in the side wall of the latter and, with its other end, is plugged such that it can be displaced into the gearbox housing 21 or into a sliding bush inserted into the latter. This sliding bush, together with the driver 22, forms a thrust joint 35, which is arranged to be offset eccentrically with respect to the mid-axis 33 and via which the roll barrel 5 is connected to the gearbox housing 21.

The oscillating mechanism illustrated functions as follows:

During printing operation, the further roll 3 rolls on the roll barrel 5 and as a result keeps the latter frictionally rotating. This rotation of the roll barrel 5 is transmitted via the driver 22 to the gearbox housing 21, which thus, together with the internal gear 24, rotates just as quickly as the roll barrel 5 about the mid-axis 33 and the roll axle 4. The internal gear 24 drives the planet wheels 26 which roll on the sun wheel 25 and drive the crank 8 in rotation via the spider 27 and the crankshaft 11. Since the step-down ratio of the step-down gearbox 23 is i=2 to 3, the spider 27, the crankshaft 11 and the crank 8 rotate at a rotational speed which is two to three times lower than that of the roll barrel 5 and of the gearbox housing 21. During its rotation about the mid-axis 33, the crank 8 executes a periodic compensating movement in the first joint 10 in order to compensate for the distance A between the second axis of rotation 30 and the mid-axis 33. The revolving crank 8 imparts a tumbling movement to the swing arm 9 attached to it, in which the first lever arm 13 executes around the fifth joint (cardan joint) 28 a movement along an imaginary movement path which has substantially the form of a cone, at the tip of which the fifth joint 28 is located. In the process, the second lever arm 15 also executes a kind of tumbling movement, in which the second lever arm 15 oscillates in two planes. A movement component of this three-dimensional oscillation of the second lever arm 15, oriented parallel to the roll axle 4, is transmitted via the coupling rod 17 to the roll barrel 5, as a result of which the latter is pushed periodically to and fro along the roll axle 4. The third joint 16 and the fourth joint 18 are used to compensate for the other movement components of the three-dimensional oscillation of the second lever arm 15.

Finally, mention should be made of a modification which is not specifically illustrated in the drawing, according to which the distance A would be zero, so that the first joint 10 could be omitted. In this case, the second axis of rotation 30 would therefore be at the level of the mid-axis 33, and the crank 8 would be connected rigidly to the crankshaft 11.

The advantage of the embodiments illustrated in the drawing, having the distance A and the crank 8 connected to the crankshaft 11 such that it can move, as compared with the aforementioned modification, is to be seen in the greater reciprocating range (linear oscillation amplitude) which can be achieved with the embodiment according to FIGS. 1 to 8.

This application claims the priority, under 35 U.S.C. § 119, of German patent application No. 103 58 543.5, filed Dec. 15, 2003; the entire disclosure of the prior application is herewith incorporated by reference.

I claim:

1. An oscillating mechanism for a distributor roll of a press, comprising:

a spatial crank mechanism for oscillating the distributor roll, said crank mechanism having a crank and a swing arm attached to said crank and disposed for oscillating in various oscillation planes, said swing arm being mounted for oscillation about a first axis of rotation and about a second axis of rotation oriented crosswise relative to said first axis of rotation.

2. The oscillating mechanism according to claim 1, wherein said swing arm is mounted in a joint having a plurality of degrees of freedom.

3. The oscillating mechanism according to claim 2, wherein said joint is a cardan joint.

4. The oscillating mechanism according to claim 1, wherein said crank mechanism includes a crankshaft oriented non-angled relative to a roll axle of the distributor roll.

5. The oscillating mechanism according to claim 4, wherein said crankshaft is disposed coaxially with the roll axle.

6. The oscillating mechanism according to claim 4, wherein said crank is articulated to said crankshaft.

7. The oscillating mechanism according to claim 1, wherein said second axis of rotation is offset by a radial distance from a center axis of said crank.

8. The oscillating mechanism according to claim 1, wherein said swing arm has a first lever arm, articulated to said crank, and a second lever arm, articulated to a roll barrel of said distributor roll.

9. The oscillating mechanism according to claim 1, wherein the distributor roll is driven in rotation by roll friction.

10. The oscillating mechanism according to claim 1, wherein said crank mechanism is disposed inside the distributor roll.

11. In combination with a printing machine, a distributor roll with an oscillating mechanism according to claim 1.

12. An oscillating mechanism for a distributor roll of a press, comprising:

a spatial crank mechanism for oscillating the distributor roll, said crank mechanism having a crank and a swing arm attached to said crank and disposed for oscillating in various oscillation planes, said swing arm being mounted in a cardan joint having a plurality of degrees of freedom.

* * * * *